United States Patent [19]

Steinmetz

[11] 4,456,299

[45] Jun. 26, 1984

[54] PROFILE SYSTEM FOR ASSEMBLING A PLURALITY OF DIFFERENT PIECES OF FURNITURE

[75] Inventor: Georg Steinmetz, Fischbach, Fed. Rep. of Germany

[73] Assignee: Tefo AG, Zug, Switzerland

[21] Appl. No.: 442,186

[22] Filed: Nov. 16, 1982

Related U.S. Application Data

[63] Continuation of Ser. No. 59,495, Jul. 23, 1979.

[51] Int. Cl.[3] ..... A47C 7/00

[52] U.S. Cl. ..... 297/440; 297/441; 312/263; 403/231

[58] Field of Search ..... 403/7, 8, 231; 297/440, 297/441; 108/153; 312/263, 257 SK

[56] References Cited

U.S. PATENT DOCUMENTS

| | | | |
|---|---|---|---|
| 2,615,540 | 10/1952 | Pressnall | 403/231 X |
| 2,831,745 | 4/1958 | Parmet | 312/257 SK |
| 3,181,923 | 5/1965 | Guillon et al. | 312/263 X |
| 3,195,968 | 7/1965 | Freeman | 312/263 X |
| 3,456,966 | 7/1969 | Muller | 403/7 |
| 3,901,571 | 8/1975 | Begitschke et al. | 312/263 |
| 3,901,612 | 8/1975 | Canin | 403/8 |
| 4,055,318 | 10/1977 | Duckett | 403/231 X |
| 4,126,364 | 11/1978 | Reilly | 312/263 |

*Primary Examiner*—Francis K. Zugel

*Attorney, Agent, or Firm*—Peter K. Kontler

[57] ABSTRACT

A profile system is provided, the profiles of which can be assembled in order to manufacture a plurality of different pieces of furniture or the like. The profiles are shaped in such a manner that the connecting elements, such as screws, are invisible. Moreover, the assembling of the profiles as well as the connecting of the profiles to panels, fabrics and other parts of pieces of furniture can be carried out easily so that laymen are able to assemble chairs, tables, beds and the like on their own.

31 Claims, 17 Drawing Figures

Fig. 2
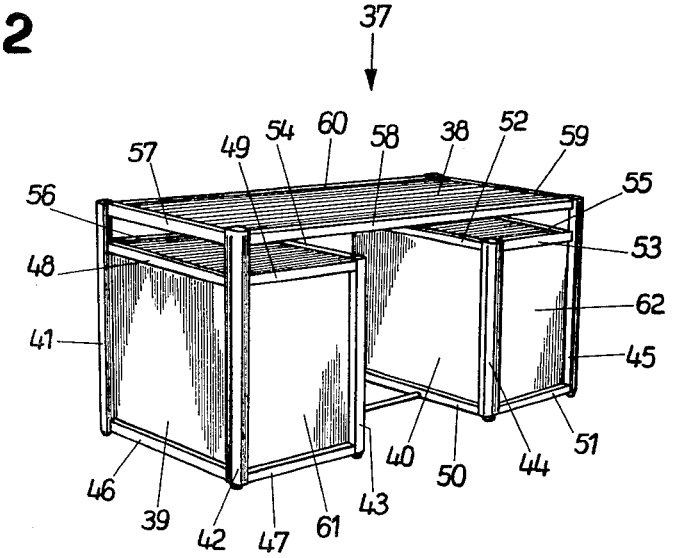
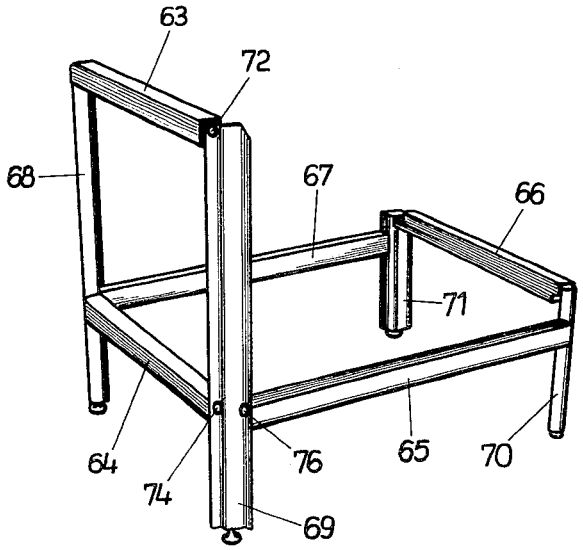
Fig. 3

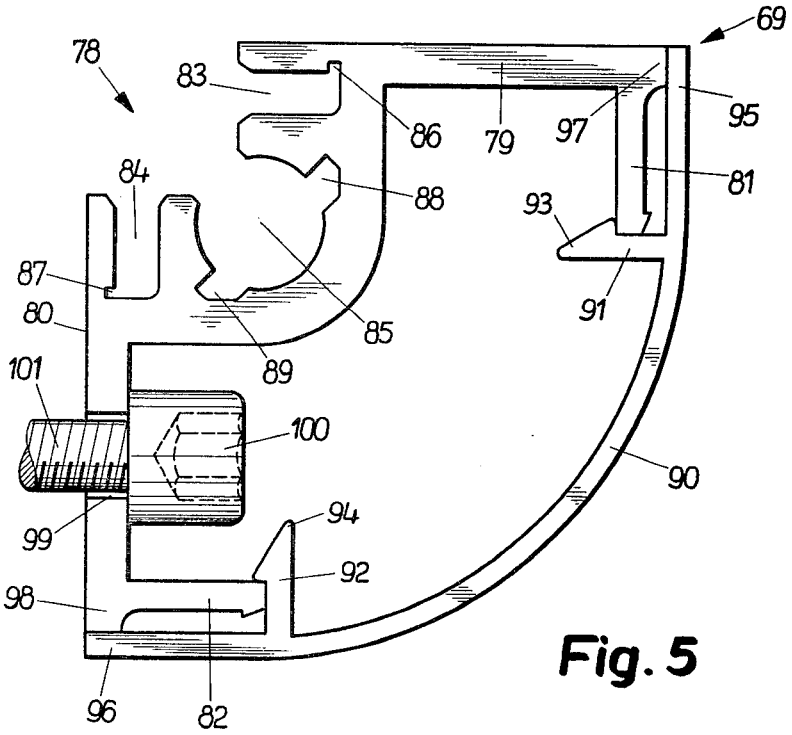
Fig. 5
Fig. 6
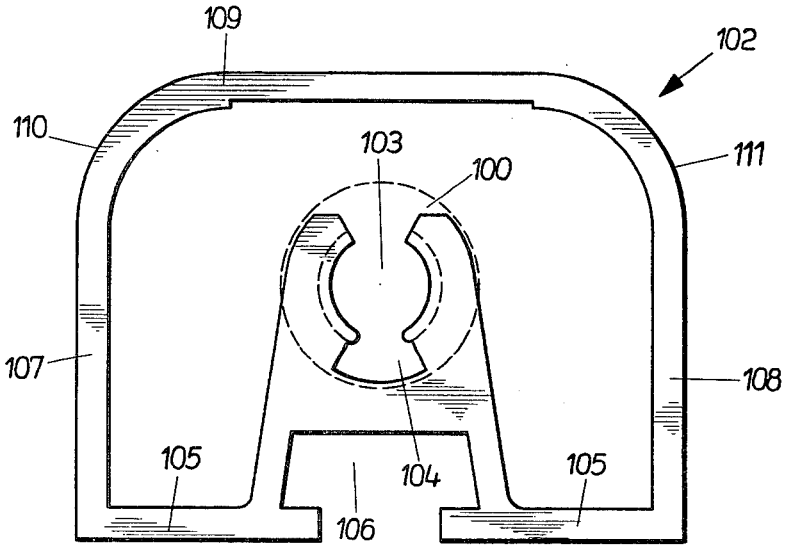

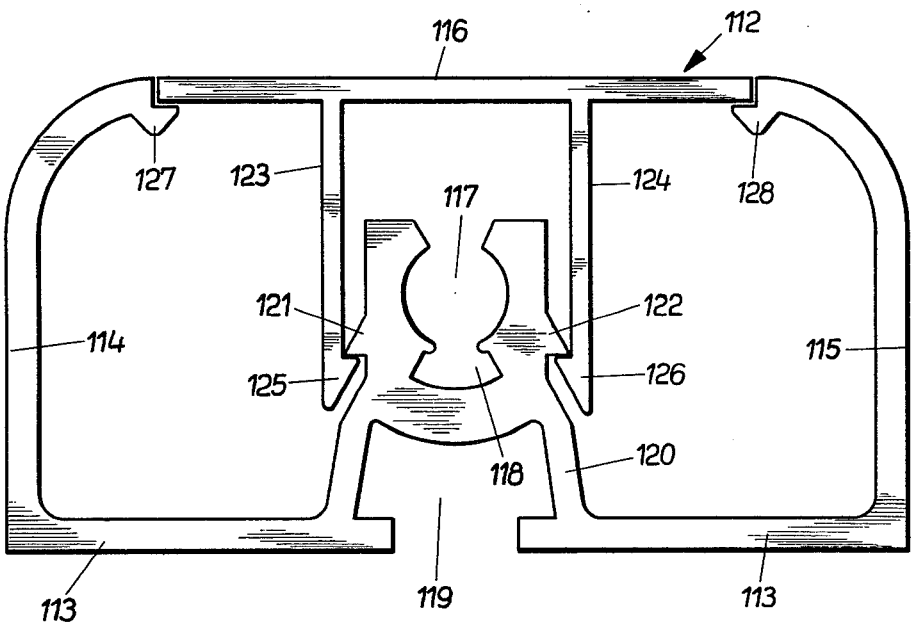
Fig. 7
Fig. 8
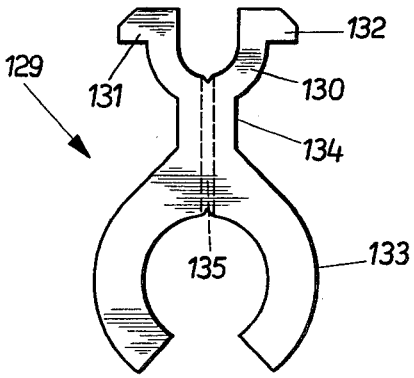
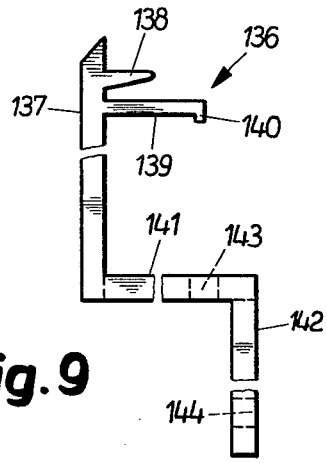
Fig. 9

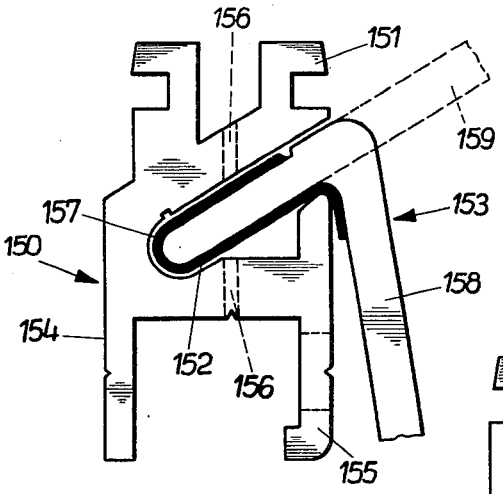
Fig. 11
Fig. 12
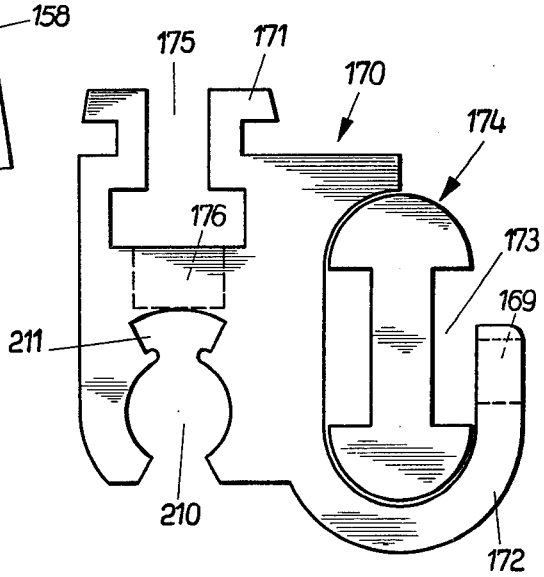
Fig. 14
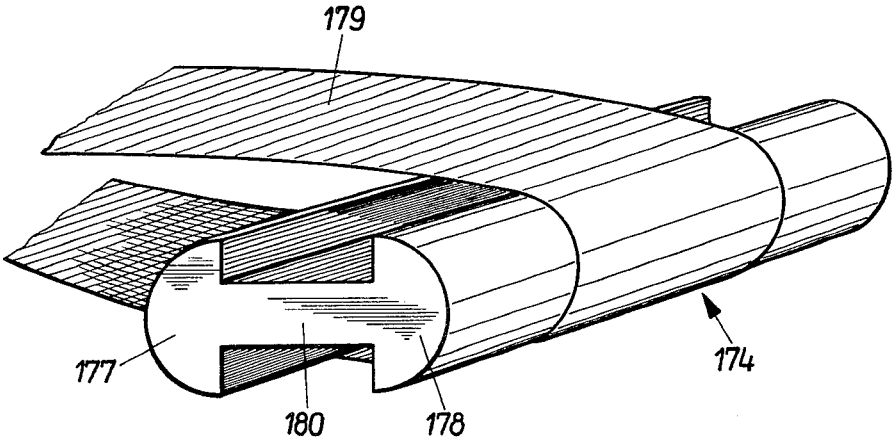

PROFILE SYSTEM FOR ASSEMBLING A PLURALITY OF DIFFERENT PIECES OF FURNITURE

This application is a continuation, of application Ser. No. 059,495, filed July 23, 1979.

BACKGROUND OF THE INVENTION

1. Field of the Invention

The present invention relates to a profile system for assembling a plurality of different pieces of furniture and parts thereof, e.g. tables, seats, sofas, beds, hall-stands, lamps, book-shelves, counters, show cases, aquariums and the like.

More particularly, the invention relates to novel profiles which are more versatile than prior art profiles.

The invention also relates to attachment members connectable to profiles.

2. The Prior Art

In the art, wooden pieces of furniture are, in general, manufactured by carpenters. However, pieces of furniture made of plastics or metals have also been proposed. These latter ones can be manufactured in an industrial process, since plastics and metals are more capable of being shaped than wood. Thus, chills having the shape of a piece of furniture can be provided and filled with plastics or metal. Due to the fact that some pieces of furniture are very bulky, those chills are comparatively voluminous. Therefore, it is more convenient to manufacture small parts of pieces of furniture only, these parts being shaped in such a manner that they can be assembled by means of screws or snap elements.

Those small parts of pieces of furniture would also meet the demand of hobby carpenters who want to manufacture their own chairs and their tables.

Whereas it is well-known in the art to sell wooden parts of pieces of furniture only and have these parts assembled by the purchaser, it is not common to sell parts of pieces of furniture made of plastics or metals.

In British Pat. No. 923 965, however, a profile of metal has been proposed which could be used as an element of a table or the like. This patent describes an angle section having a screw channel which is arranged in the corner of the angle section. At its inner side the angle section comprises a groove for inserting additional parts. By means of this well-known angle section, however, it is not possible to assemble good-looking pieces of furniture, because the connecting screws and the like are visible.

More suitable profiles for assembling pieces of furniture have been proposed in the German Patent Application No. 25 19 607. These profiles comprise locking pins and capping means for establishing a snap locking beween the capping and the angle section of the profiles, thus masking the screws which connect the different profiles to each other. However, the guideway means of these profiles for receiving attachment members which are, in turn, connectable to parts of pieces of furniture, are less versatile. Moreover, no attachment members can be clamped into the profiles, and the process of manufacturing the profiles is rather complicated, since two screw channels are provided in the profiles.

SUMMARY OF THE INVENTION

Accordingly, it is a general object of the present invention to overcome the disadvantages of the prior art.

More particularly, it is an object of the invention to provide a profile system for assembling a plurality of different pieces of furniture, the profiles of which are capable of receiving a plurality of attachment members.

It is another object of the invention to provide capping means which can be connected to angle sections by snapping or pushing in order to cover the screws connecting the profiles to each other.

A concomitant object of the invention is to provide a profile system of the type under discussion which embodies a profile, the central guideway means of which is shaped in such a manner that it is capable of receiving screws for elevation setting as well as covering caps and attachment members.

Another object is to provide a profile comprising guideway means in which attachment members can be clamped.

Still a further object of the invention is to provide a covering cap for profiles which can be introduced into these profiles without screwing.

Another object is to provide profiles preferably comprising only one screw channel.

Still another object of the invention is to provide impact cushioning means connectable to the profiles.

In keeping with these objects, and still other which will become apparent from a reading of the description following hereafter, one aspect of the invention resides in a profile the webs of which are arranged at a defined angle to each other, said webs comprising means for connecting a capping to said webs.

BRIEF DESCRIPTION OF THE DRAWING

For a fuller understanding of the invention, reference is had to the following description taken in connection with the accompanying drawings, in which:

FIG. 2 is an office table, the frame of which is assembled by means of profiles according to the present invention;

FIG. 3 is a frame of a seat being assembled by means of profiles;

FIG. 5 is a cross sectional view of a first profile preferably used as a post;

FIG. 6 is a cross sectional view of a second profile, preferably used as a cross member;

FIG. 7 is a cross sectional view of a third profile, used as a post and as a cross member;

FIG. 8 is an attachment member for introduction into the guiding means of a profile;

FIG. 9 is a second attachment member for clamping in the guideway means of a profile;

FIG. 11 is a sectional view of a third attachment member for introduction into the guideway means of a profile;

FIG. 12 is a sectional view of a fourth attachment member capable of being introduced into the guideway means of a profile;

FIG. 14 is a part of an attachment member being connected to a fabric;

DESCRIPTION OF PREFERRED EMBODIMENTS

Figure 1:
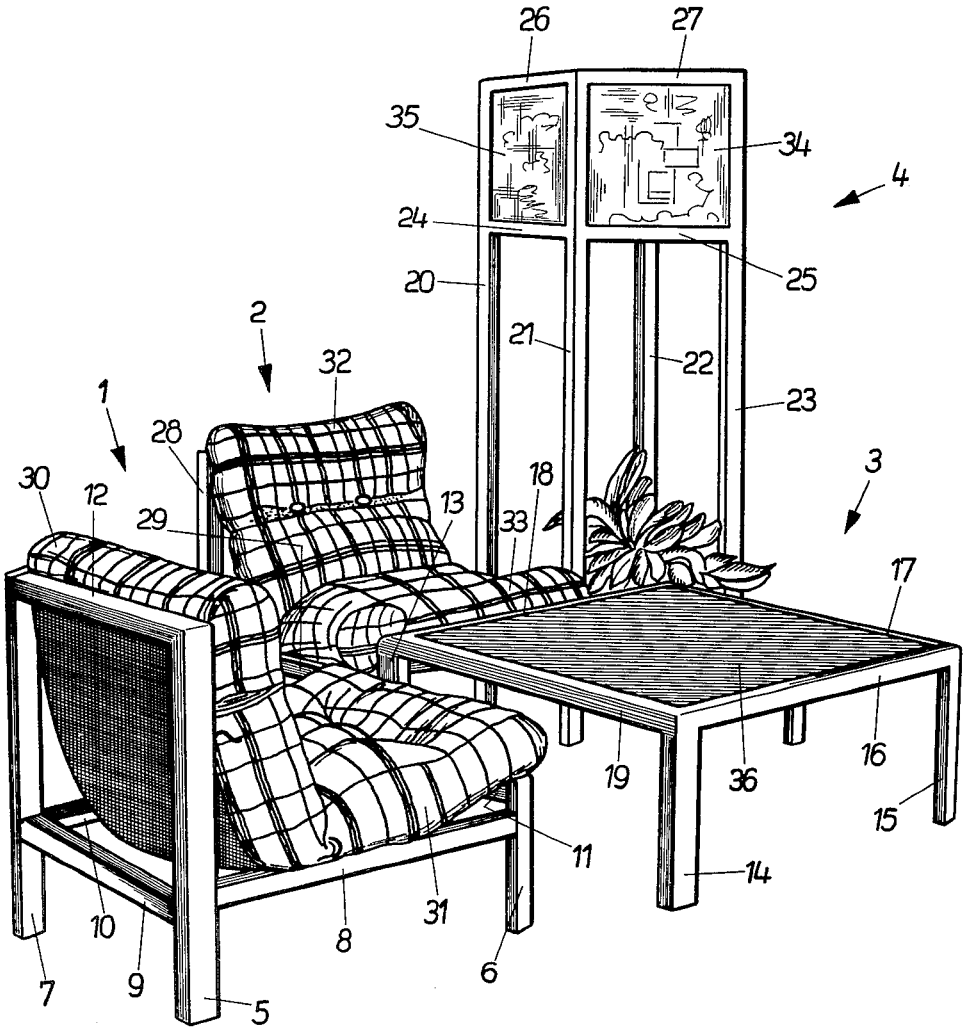
FIG. 1 shows a table, a lamp and seats, the frames of which are assembled by means of profiles according to the present invention.

Referring now to FIG. 1, the furniture depicted therein comprises two seats 1,2 as well as a table and a lamp 4. These pieces of furniture are all assembled by using the same profiles. Seat 1, for instance, comprises four vertical profiles, three of which can be seen in FIG. 1 and which are designated as 5,6,7, and five horizontal profiles 8,9,10,11,12. The vertical profiles are of a first type, whereas the horizontal profiles are of a second type.

Similarly, table 3 comprises vertical profiles 13,14,15 and horizontal profiles 16,17,18,19. The vertical profiles of the lamp 4 are designated with reference numerals 20,21,22,23, whereas the horizontal profiles of said lamp 4 are designated with reference numerals 24,25,26,27.

Most of the profiles of seat 2 are hidden in FIG. 1, however, a vertical profile 28 and a horizontal profile 29 are visible. As can be understood from FIG. 1, a plurality of pieces of furniture can be achieved by assembling two different types of profiles only.

More particularly, it is possible to assemble a plurality of different frames by means of two different types of profiles, these profiles being made of aluminium and manufactured by an extrusion process or the like. The profiles, in turn, are connected to each other by means of screws or similar connection means. These screws are not visible due to the special structure of the profiles.

The frames assembled by the profiles are filled up with certain parts of pieces of furniture, e.g. with seating-cushions 30,31,32,33, with painted panes of glass 34,35 or with a table-plate 36. As will be described hereinbelow, the profiles comprise guideway means for receiving attachment members which, in turn, can be connected to panes of glass, table-plates, cushions and the like.

FIG. 2 shows an office table 37 comprising a table-chart 38 and two filing cabinets 39,40. The frame of this office table 37 is assembled by means of a plurality of vertical profiles 41–45 and horizontal profiles 46–60. Between most of these profiles 41–45, 46–60 panels, e.g. panels 61,62, are inserted. These panels 61,62 are connected to guideway means of horizontal and/or vertical profiles. FIG. 2 illustrates that pieces of furniture which are of a comparatively complicated shape can be assembled by means of the profiles.

In their final assembling state the profiles are provided with cappings in order to hide screws connecting the horizontal and vertical profiles to each other.

FIG. 3 depicts a frame of a seat, wherein the frame comprises five horizontal profiles 63–67 and four vertical profiles 68–71. The capping of profile 69 is removed. Thus, the screws 72,74,76 connecting the horizontal profiles 64,65 to the vertical profile 69 are visible.

Figure 4:
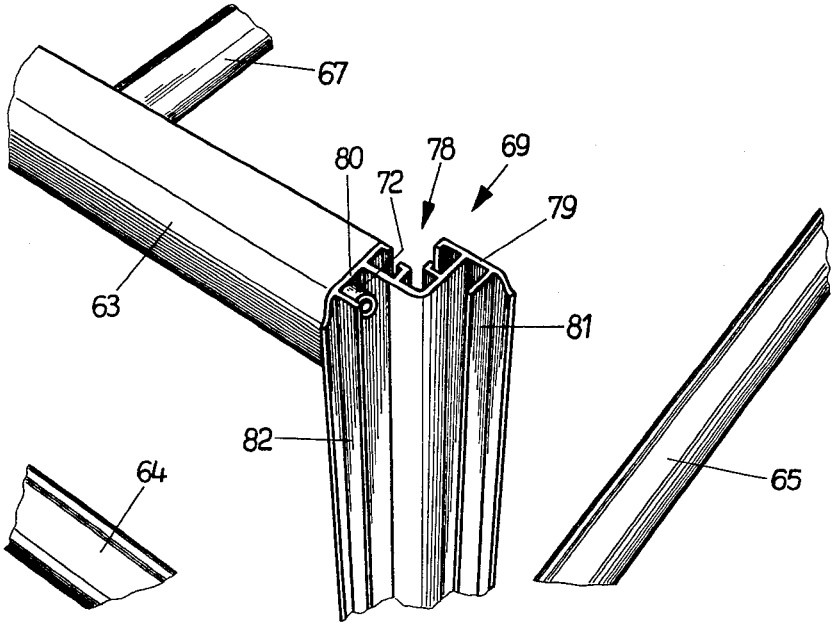
FIG. 4 illustrates the upper edge of the back of the frame shown in FIG. 3.

FIG. 4 depicts a part view of the vertical profile 69 as shown in FIG. 3. Some of the other profiles, e.g. profiles 63,64,65,67 are also visible. The vertical profile 69 comprises guideway means 78 for receiving attachment members which are, in turn, connectable to parts of pieces of furniture and the like. Moreover, the vertical profile comprises two webs 79,80, each of said webs 79,80 having a leg 81,82 for connecting a capping to the webs 79,80. By means of a screw 72 a connection between the vertical profile 69 and the horizontal profile 63 is established.

FIG. 5 shows a profile 69 in a sectional view from above and together with a capping 90. The guideway means 78 of this profile 69 comprise a first guideway means 83, a second guideway means 84 and a third guideway means 85. These guideway means 83,84,85 are shaped in such a manner that attachment members can be inserted which, in turn, are connectable to table plates, to fabrics for seats or the like. Such attachment members will be described hereinbelow.

The first and second guideway means 83,84 are of a substantially rectangular shape with one side open and having grooves 86,87 in their corners. These guideway means 83,84 are aligned with the webs 79,80 and include a right angle Between said first and second guideway means 83,84 a third guideway means 85 is provided. The axis of symmetry of this third guideway means 85 includes an angle of 45° in view of the longitudinal axis of said first and second guideway means 83,84.

The third guideway means 85 is shaped as a circular channel with an open side, having two extensions 88, 89 for receiving guide bars and the like.

A capping 90 is connected to the profile 69 by means of two legs 91,92 having barbs 93,94 at their ands, these barbs 93,94 establishing a snap locking with the legs 81,82 of the webs 79,80. In order to assure that the ends 95,96 of the capping 90 seal off the profile 69, the legs 81,82 are arranged at a distance from the ends 97,98 of the webs 79,80.

In the webs 79,80 holes, for instance hole 99, are provided through which shafts of screws can be put, in order to connect one profile to another. When the capping 90 is taken away, the head 100 of a screw 101 may be turned by means of a screw driver so as to establish the connection between two profiles.

The guideway means 85 may comprise a screw thread for introducing a screw which may serve as an elevation adjustment when the profile 69 is used as a vertical post.

A second profile 102 to which the profile 69 may be connected is shown in FIG. 6. This profile 102 comprises a circular channel 103 for receiving, for instance, the screw 101 shown in FIG. 5. Next to the circular channel 103 a hole 104 for receiving a pin or the like is provided in order to avoid any turning of the profile 102 relative to the profile 69 when both profiles are connected to each other by means of a screw. When driving the screw, a pin is pushed by the head of said screw into the hole next to the taphole of the screw. This pin can be provided in the hole or inserted into the hole prior to threading in of the screw.

By using said pin, a second screw can be avoided which otherwise would be necessary to prevent a relative turning between two profiles.

The circular channel 103 as well as the hole 104 are surrounded by a basic plate 105 comprising a guide groove 106 for receiving attachment members which are, in turn, connectable to parts of pieces of furniture or the like. The ends of the basic plate 105 change over into the side walls 107,108 which, in turn, change over into a wall 109 parallel to the basic plate 105, thereby forming curves 110,111.

FIG. 7 shows a third profile 112 which can serve as a vertical port and as a horizontal connecting member as well. Thus, this profile 112 can replace profile 69 as well as profile 102.

The hollow space of this profile 112 is surrounded by a basic plate 113, two side walls 114,115, and a capping 116. In the middle of the hollow space a circular channel 117 and a hole 118 are provided as is the case with profile 102 of FIG. 6.

A guide groove 119 extends from the basic plate 113 in order to receive attachment members. The circular channel 117, the hole 118 and the guide groove 119 are shaped by means of a formation 120 having two hooks 121,122 on its surface. Two legs 123,124 extend from the capping 116 and reach to the hooks 121,122, said legs comprising barbs 125,126 at their respective ends. These barbs 125,126 are shaped in such a manner that they enable a snap locking with the hooks 121,122. When the capping 116 is connected to the profile 112, the surfaces of the curved ends of the sidewalls 114,115 and the surface of the capping 116 are flush. This effect is achieved by means of supports 127,128 having a suitable shape.

FIG. 8 depicts an attachment member 129 for connecting parts of pieces of furniture to the profile 69. The attacment member 129 comprises a semicircular clevis hook 130, the ends of which are provided with bent arms 131,132, and a supporting head 133 which is connected to the clevis hook 130 by means of a bridge 134. The supporting head 133 is shaped as an open ring being capable of receiving a rubber pin or the like. A panel, e.g. table plate 36 of FIG. 1, may be laid upon such a rubber pin. The bridge 134 is provided with a hole 135 for receiving an endless screw or a flat-point screw in order to lock the attachment member 129 to a profile.

FIG. 9 shows another attachment member 136 which can be connected to the profile 69 and to parts of pieces of furniture as well. This attachment member 136 comprises a ledge 137 having two off-springs 138,139, the latter one comprising a nozzle 140 which can be inserted into a groove of a guideway means.

Two flanges 141,142 are connected to the ledge 137 and provided with holes 143,144 or the like. Screws may be put through these holes so as to connect parts of pieces of furniture or the like to the attachment member 136.

Figure 10A:
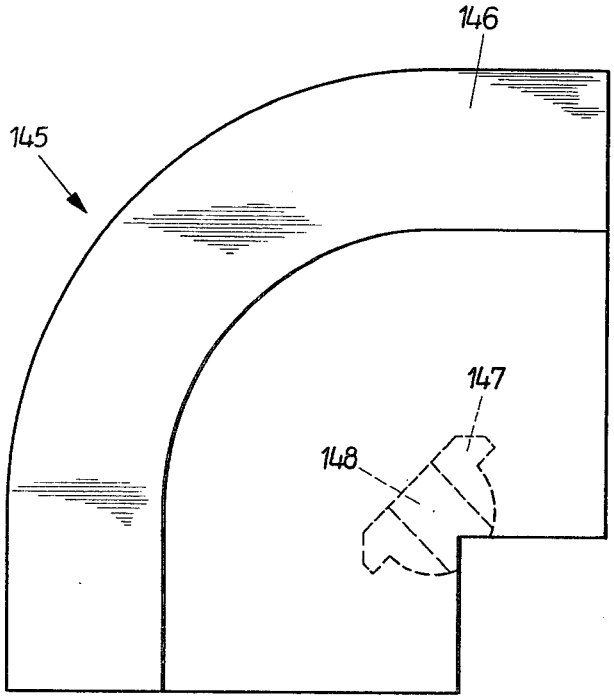
FIG. 10*a* is a cap for sealing the open end of a profile, seen from above.

FIG. 10*a* depicts a covering cap 145 for covering the ends of a profile, as seen from above. This cap comprises an arched periphery 146, a shaft 147 (dotted lines) and a hole 148 for a setscrew.

Figure 10B:
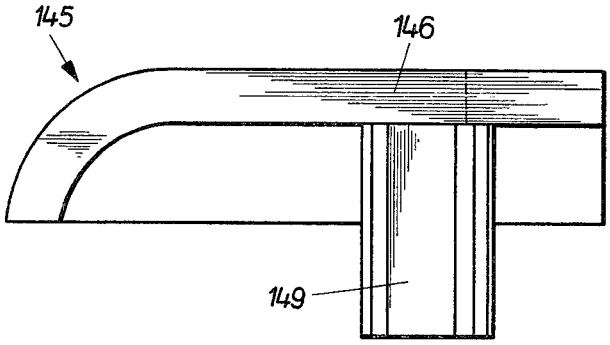
FIG. 10*b* is the cap of FIG. 10*a* as seen from one side.

In FIG. 10*b* the same cap 145 is shown from one side. As can be understood from looking at this figure, a shaft 149 is provided which can be inserted into the hole 85 of the shaft 69 and connected to a profile by means of a setscrew.

Another attachment member 150 for establishing a connection to the profiles 102,112 is shown in FIG. 11. This attachment member 150 comprises a guide bar 151 for being received by the guideways 106 and 119 of the profiles 102,112, respectively. It is also provided with an inclined opening 152 for receiving suspension fastening means 153, and with two side walls 154,155 connectable to panels and the like. Moreover, a hole 156 for receiving a screw in order to lock the attachment member 150 to a profile is provided.

The suspension fastening means 153 comprise a U-shaped cramp 157 for clamping the end of a seat belt 158 or the like which may serve to provide springiness. The seat belt 158 is shown in a second position as belt 159 so as to illustrate that it is flexible. It is, of course, possible and often necessary to connect the second end of the belt 159 with another U-shaped clamp which is clamped into another attachment member.

FIG. 12 shows still another attachment member 170 for connection to the profiles 102,112, e.g. by inserting it into the grooves 106,119. In order to achieve this connection, a guide bar 171 is provided which is connected to a housing 172 comprising a substantially elliptical hole 173. A dumbbell 174 can be inserted into this elliptical hole 173, whereby this dumbbell 174 serves as a supporting member for fabrics and the like. By means of a screw which is put through the hole 169 the dumbbell can be adjusted.

The guide bar 171 includes a space 175 opposite a hole 176. By putting the shaft of a screw through the hole 176 and the space 175, the attachment member 170 is locked to a profile. To make the attachment member even more versatile, a circular channel 210 and a hole 211 are provided. By means of these elements it is possible to connect the attachment member to a profile not only by inserting it into a guideway of a profile, but also by screwing it to a profile. Moreover, by using these different kinds of connection, a 90° turn of the attachment member is achieved.

Figure 13:
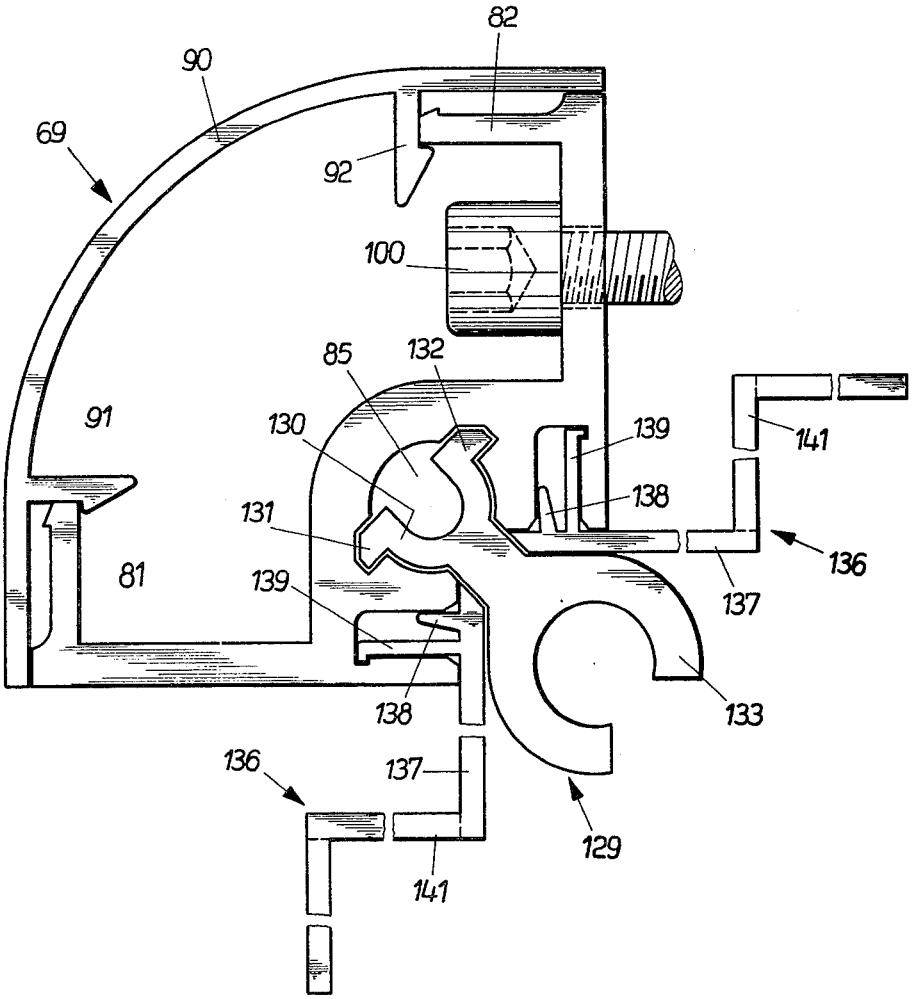
FIG. 13 illustrates a profile connected with three attachment members.

FIG. 13 depicts a profile 69 as shown in FIG. 5, together with three attachment members 133,136,136 as shown in FIGS. 8 and 9, respectively. As can be seen from FIG. 13, the attachment members are shaped in such a manner that they do not hinder each other, i.e. it is possible to insert three attachment members at the same time into the guideway means 78 of the profile 69.

FIG. 14 shows a dumbbell 174 as depicted in FIG. 12 in a perspective view. This dumbbell 174 comprises two elongated bars 177,178 of semicircular shape which are bridged by a quadrilateral strip 180. A fabric 179 is wound around and connected to this dumbbell 174. The ends of the dumbbell 174 are inserted into attachment members 170 as shown in FIG. 12 so as to stretch or set the fabric 179.

Figure 15:
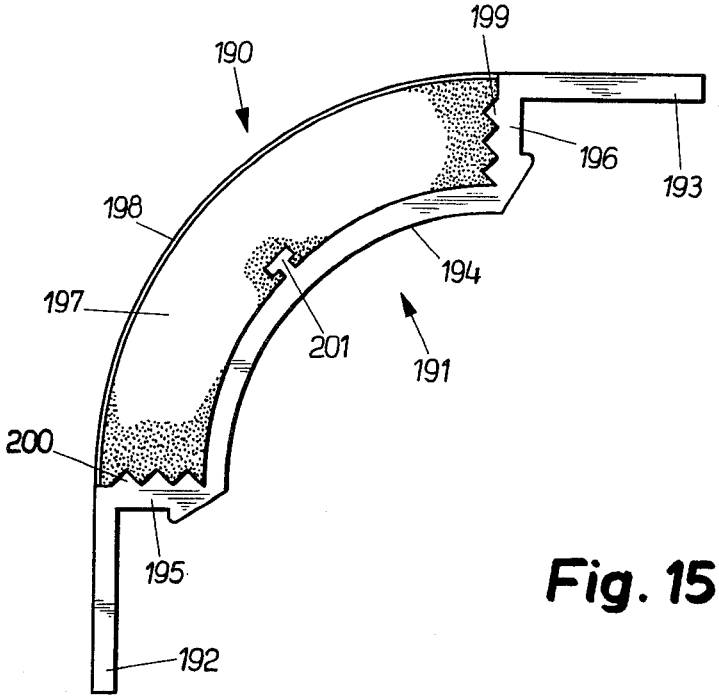
FIG. 15 is a capping for a first profile comprising impact-cushioning means.

FIG. 15 depicts a capping 190 which can replace capping 90 of FIGS. 5 and 13. Since in some countries rules concerning the safety of furniture do exist, it is necessary to provide, at least in these countries, soft corners for the profiles. Therefore, capping 190 comprises a metal plate 191, preferably of aluminium, having roughly the form of an M with outwardly stretched shanks 192,193. These shanks 192,193 are connected to each other by a curved bridge 194, said bridge comprising two legs 195,196. Between these legs 195,196 elastic and aerated plastics or foam material 197 is injected and then covered by a more rigid plastic 198 or other rigid material, e.g. a thin metal plate. In order to adjust the aerated plastics 197 and the rigid plastics 198 between the legs 195, 196 and the bridge 194, the legs are provided with teeth 199,200, and the bridge comprises a nipple 201.

Figure 16:
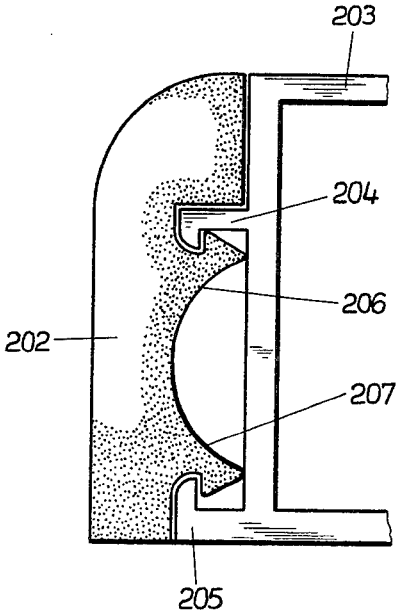
FIG. 16 is a capping for a second profile comprising impact-cushioning means.

FIG. 16 shows another capping 202 which may replace the left and/or the right part of the profiles 102 and 112 as depicted in FIGS. 6 and 7. Part 203 of the profile shown in FIG. 16 comprises two hooks 204, 205, and the capping 202 is made of aerated plastics or foam material, similar to the material of the capping 190 of FIG. 15. However, whereas the capping 190 was foamed into the hollow space between the legs 195,196, the capping 202 is manufactured in advance and then pressed in so as in order to establish a connection between the teeth 206,207 of the capping 202 and the hooks 204,205.

It is a very important advantage of the present invention that the cappings of the profiles can be exchanged. If, for instance, some forms of profiles go out of fashion, new cappings with a new outer design can easily be manufactured without being the need to manufacture new webs and attachment members, too. Instead of an arched surface of the cappings a wave-like shape of the surface, for instance, can be achieved. Moreover, the cappings can be provided with different colours and/or top surface coverings, e.g. by means of an electrolytic surface oxidation of aluminium in an oxalic or sulfuric acid bath.

It is to be understood that the described embodiments are merely illustrative of the invention. Numerous other arrangements may be designed by those skilled in the art without departing from the spirit and scope of the invention. The threaded bush, for instance, which is used for receiving a screw, may also serve as a means for putting in the end of a wave-like spring of steel. Also, if a big profile is needed, two guideway channels instead of one can be provided, or even more.

Instead of pieces of furniture, other arrangements can be assembled. By connecting four profiles of the post-type, for instance, a circular column can be achieved, each profile establishing one quarter of the circle. Moreover, panels can be inserted between two of those profiles, thus creating a central column with four outwardly directed panels.

I claim:

1. Apparatus for connecting together different pieces of furniture, said apparatus comprising:

at least one elongated first profile having at least two main webs extending at predetermined angles relative to each other, each having longitudinally spaced-apart first edge portions and distal second edge portions; a connecting web connecting said first edge portions, one side of said connecting web defining in combination with said main webs a hollow portion with an open side at said second edge portions; means for connecting a capping to said main webs to cover said open side; and guideway means being provided at said opposite side of said connecting web, said guideway means adapted to receive attachment members;

at least one attachment member for supporting other elements of said article of furniture, said attachment member being adapted to be inserted into and received in said guideway means; and at least one second profile connectable to said at least one first profile by connecting means.

2. Apparatus as defined in claim 1, said guideway means comprising first, second and third guideway means for respectively receiving first, second and third attachment members.

3. Apparatus as defined in claim 1, wherein said two main webs are arranged at right angles to one another, and said guideway means is on said connecting web.

4. Apparatus as defined in claim 1, wherein each of said main webs comprises a leg arranged at a right angle on the respective web, and further comprising a capping having two legs, each of said two legs being capable of establishing a snapping or sliding connection with the legs of said webs.

5. Apparatus as defined in claim 1, wherein said capping is a metal sheet having the form of a part of a circle the ends of said part being extended by a respective straight leg.

6. Apparatus as defined in claim 2, wherein the third guideway means is a circular channel having two extensions and an opening.

7. Apparatus as defined in claim 2, wherein the first and second guideway means are rectangular channels with one side open, said guideway means also comprising at least one groove on an inner side of at least one of their walls.

8. Apparatus as defined in claim 2, wherein said first and said second guideway means are arranged at right angles to each other.

9. Apparatus as defined in claim 2, wherein said third guideway means lies between said first and said second guideway means and includes an angle of 45° with respect to said first and said second guideway means.

10. Apparatus as defined in claim 4, wherein said legs of said webs are arranged at a distance from the ends of the webs.

11. Apparatus as defined in claim 4, wherein said legs of said capping comprise a barb at their respective ends.

12. Apparatus as defined in claim 1, wherein said second profile comprises:

at least one circular channel with an open side; and at least one guide groove for receiving attachment members, said attachment members being connectable to parts of pieces of furniture or the like.

13. Apparatus as defined in claim 12, wherein said second profile comprises a basic plate and two side walls, said sidewalls merging into a wall parallel to said basic plate.

14. Apparatus as defined in claim 12, wherein said second profile comprises a basic plate and two side walls, said two side walls being bridged by a capping.

15. Apparatus as defined in claim 12, wherein said guide groove and said circular channel extend from a basic plate.

16. Apparatus as defined in claim 14, wherein said capping comprises two legs, each of these legs being provided with a respective barb, said barb being connectable to a respective hook which is arranged on the formation defining the circular channel.

17. Apparatus as defined in claim 1, wherein said guideway means of said first profile serve as a nut for receiving a screw so as to vary the height of the profile when it is used as a post, and wherein said guideway means of said first profile serve as a receiver of a shaft, said shaft being connected to a cover plate for capping the hollow space of said first profile.

18. Apparatus as defined in claim 17, wherein said shaft is provided with a hole for a screw so as to secure said shaft to said first profile.

19. Apparatus as defined in claim 18, wherein a top of said screw is pressed against the profile so as to secure said shaft by wedging.

20. Apparatus as defined in claim 12, wherein said circular channel is provided with an extension for receiving a bolt or the like so as to block changing of said second profile when connected to said first profile by means of a screw which is put through a hole of the first profile and screwed into said circular channel.

21. Apparatus as defined in claim 1, wherein said attachment member comprises a semicircular clevis hook, the ends of which are provided with bent arms.

22. Apparatus as defined in claim 21, wherein said clevis hook is connected to a supporting head or the like by means of a bridge.

23. Apparatus as defined in claim 21, wherein said supporting head is an open ring, said open ring being capable of receiving a rubber pin or the like.

24. Apparatus as defined in claim 1, wherein the attachment member comprises a ledge having two off-springs, said off-springs being arranged close to each other and one of them comprising a nozzle, said nozzle being capable of snapping into a groove of one of said guideway means.

25. Apparatus as defined in claim 24, wherein said ledge is connected to at least one flange, said flange being connectable to panels, fabrics or the like.

26. Apparatus as defined in claim 1, wherein the attachment member comprises:

a guide bar for being received by a guideway;

an inclined opening for receiving suspension fastening means;

two side walls, said side walls being connectable to panels and the like; and at least one hole for receiving a screw or the like, said screw locking the attachment member to a profile.

27. Apparatus as defined in claim 26, wherein said suspension fastening means comprise a U-shaped clamp, said clamp adapted to clamp an end of a seat belt or the like.

28. Apparatus as defined in claim 1, wherein the attachment member comprises:

a guide bar for being received by a guideway; and a substantially elliptical hole, said hole being capable of receiving a dumbbell, said dumbbell being connectable to the fabric of a seat or the like.

29. Apparatus as defined in claim 28, wherein the attachment member comprises a hole for receiving a screw, said screw adjusting the dumbbell within said substantially elliptical hole.

30. Apparatus as defined in claim 1, wherein the profiles comprise impact-cushioning means.

31. Apparatus as defined in claim 30, wherein said impact-cushioning means comprise aerated synthetic plastic material.

* * * * *